US006767162B2

(12) United States Patent
Meyers et al.

(10) Patent No.: US 6,767,162 B2
(45) Date of Patent: Jul. 27, 2004

(54) SYSTEM AND APPARATUS FOR RAPIDLY INSTALLED BREAKWATER

(75) Inventors: Frank Meyers, Redondo Beach, CA (US); John A. Brown, Redondo Beach, CA (US)

(73) Assignee: Kepner Plastics Fabricators, Inc., Torrance, CA (US)

( * ) Notice: Subject to any disclaimer, the term of this patent is extended or adjusted under 35 U.S.C. 154(b) by 0 days.

(21) Appl. No.: 10/190,224

(22) Filed: Jul. 5, 2002

(65) Prior Publication Data

US 2002/0197111 A1 Dec. 26, 2002

Related U.S. Application Data

(63) Continuation of application No. 09/751,164, filed on Dec. 29, 2000, now abandoned.

(51) Int. Cl.[7] ..... E02B 3/06; B63B 35/44

(52) U.S. Cl. ..... 405/23; 405/22; 405/26; 405/32; 405/34; 405/115; 114/267

(58) Field of Search ..... 405/15, 21, 22, 405/23, 26, 31–34, 63–72, 91, 102, 115; 114/267, 294, 249, 250; 441/1, 30, 31

(56) References Cited

U.S. PATENT DOCUMENTS

| | | | | |
|---|---|---|---|---|
| 1,004,718 A | * | 10/1911 | Wieland | 405/26 |
| 3,237,414 A | * | 3/1966 | Straub et al. | 405/26 |
| 3,503,214 A | | 3/1970 | Desty et al. | |
| 3,503,512 A | | 3/1970 | Desty et al. | |
| 3,635,032 A | | 1/1972 | Desty et al. | |
| 3,703,811 A | * | 11/1972 | Smith | 405/68 |
| 3,791,150 A | * | 2/1974 | Tachii | 405/27 |
| RE28,966 E | * | 9/1976 | Blockwick | 405/70 |
| 3,991,576 A | * | 11/1976 | Tazaki et al. | 405/21 |
| 4,027,486 A | * | 6/1977 | Dougherty | 405/26 |
| 4,068,478 A | | 1/1978 | Meyers et al. | |
| 4,112,689 A | | 9/1978 | Webb | |

(List continued on next page.)

FOREIGN PATENT DOCUMENTS

| | | | | |
|---|---|---|---|---|
| GB | 1163173 | | 9/1966 | |
| GB | 1188156 | | 4/1970 | |
| GB | 1366680 | | 11/1971 | |
| GB | 1486976 | | 2/1975 | |
| GB | 2 013 585 A | | 1/1979 | |
| GB | 2 013 583 A | | 8/1979 | |
| GB | 2 044 727 A | | 10/1980 | |
| WO | 92/06039 | * | 4/1992 | 405/63 |

OTHER PUBLICATIONS

Web site: *http://www.newscientist.com/ns/1990911/last-word.html* –article on Web site dated Sep. 11, 1999 on "oil barges".

Web site article: *http://www.nrt.org/nrt/home.nsf/bal* dated Apr. 1995 on: "Temporary Storage Devices –Towable: A tool that fulfills an oil spill response need".

Activities described in Information Disclosure Statement to which these Citations are attached (Jan. 29, 2004).

*Primary Examiner*—Jong-Suk James Lee
(74) *Attorney, Agent, or Firm*—Fulwider Patton Lee & Utecht, LLC

(57) ABSTRACT

A rapidly deployable breakwater is disclosed having a primary barrier containing liquid under pressure, and one or more overtopping barriers. The primary barrier floats at, and extends substantially below, the surface of the water, while the overtopping barriers are positioned on the primary barrier and extend substantially above the surface of the water, the combination being adapted to attenuate wave action in open water. The liquid in the primary barrier is pressurized to a level substantially greater than the pressure of the surrounding water, and such pressure may be maintained or varied during the period of deployment of the breakwater.

51 Claims, 6 Drawing Sheets

U.S. PATENT DOCUMENTS

| | | | | | |
|---|---|---|---|---|---|
| 4,123,911 | A | | 11/1978 | Finigan et al. | |
| 4,140,424 | A | | 2/1979 | Bretherick et al. | |
| 4,207,191 | A | | 6/1980 | Webb | |
| 4,234,266 | A | * | 11/1980 | Angioletti | 405/26 |
| 4,244,819 | A | * | 1/1981 | Ballu | 405/68 |
| 4,295,755 | A | | 10/1981 | Meyers | |
| 4,310,415 | A | | 1/1982 | Webb | |
| 4,342,655 | A | | 8/1982 | Webb | |
| 4,392,957 | A | | 7/1983 | Webb | |
| 4,693,631 | A | | 9/1987 | McKay | |
| 4,712,944 | A | * | 12/1987 | Rose | 405/21 |
| 4,752,393 | A | | 6/1988 | Meyers | |
| 4,776,724 | A | * | 10/1988 | Isozaki | 405/26 |
| 4,981,392 | A | * | 1/1991 | Taylor | 405/21 |
| 5,107,784 | A | * | 4/1992 | Lacy | 114/263 |
| 5,125,767 | A | * | 6/1992 | Dooleage | 405/21 |
| 5,215,027 | A | | 6/1993 | Baxter | |
| 5,242,243 | A | | 9/1993 | Bachelier | |
| 5,304,005 | A | | 4/1994 | Loeffler-Lenz | |
| 5,480,261 | A | | 1/1996 | Meyers et al. | |
| 5,522,674 | A | * | 6/1996 | Cooper | 405/63 |
| 5,558,459 | A | | 9/1996 | Odenbach et al. | |
| 5,584,604 | A | * | 12/1996 | Osterlund | 405/68 |
| 5,702,203 | A | | 12/1997 | Resio et al. | |
| 5,707,172 | A | | 1/1998 | Wilcox | |
| 5,775,248 | A | * | 7/1998 | Simola | 114/267 |
| 5,803,659 | A | | 9/1998 | Chattey | |
| 5,984,577 | A | * | 11/1999 | Strong | 405/21 |
| 5,993,113 | A | * | 11/1999 | Darling | 405/21 |

* cited by examiner

FIG. 5
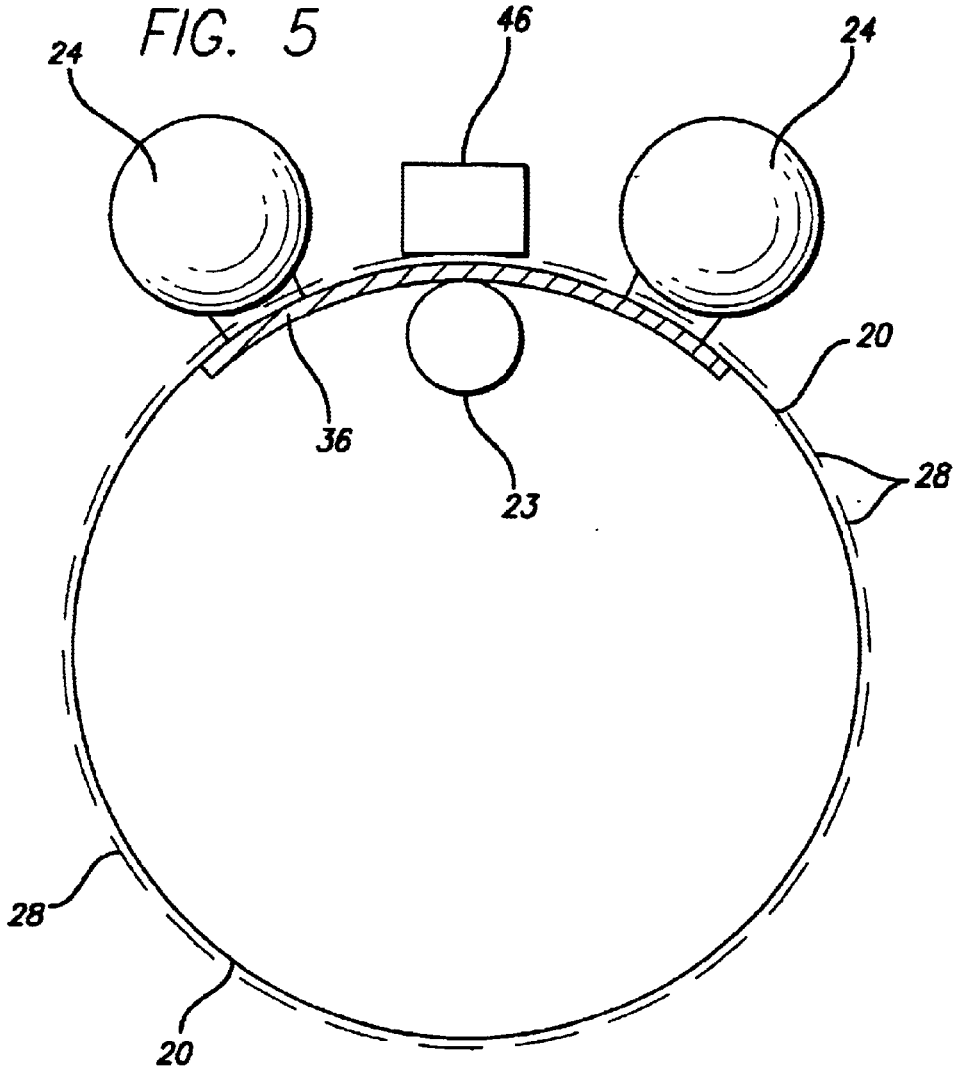
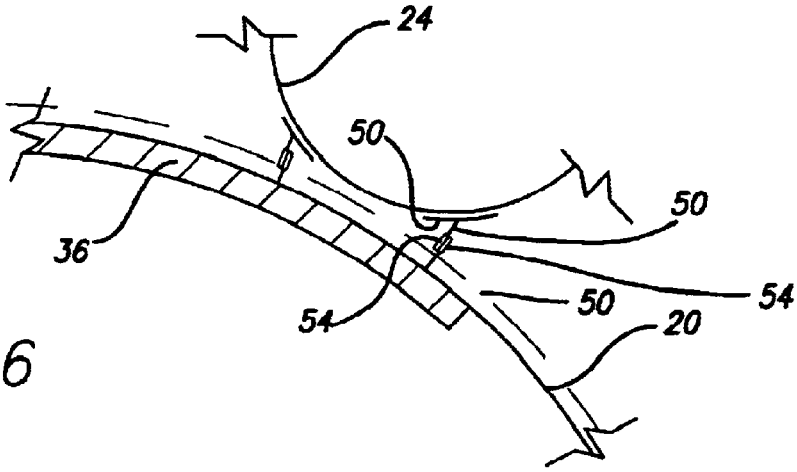
FIG. 6

SYSTEM AND APPARATUS FOR RAPIDLY INSTALLED BREAKWATER

RELATED APPLICATIONS

This application is a continuation of U.S. application Ser. 09/751,164 filed Dec. 29, 2000, abandoned.

BACKGROUND OF THE INVENTION

The present invention relates generally to floating breakwaters, and more particularly, to floating breakwater systems capable of rapid deployment and retrieval, and capable of breaking or attenuating wave action in open water. In this application, "open water" is used to denote any open water including ocean water, lake water, river water, dam water, and the like.

Breakwaters are typically either bottom-mounted or floating. Bottom-mounted structures are generally composed of large rocks ("rip-rap") or concrete, and are massive permanent structures. Floating breakwaters have been used for some time as non-permanent structures at harbor entrances, swimming beaches, offshore construction, or for military operations. Typically, these structures include a substantially submerged element which has enough inertial mass to absorb incoming wave energy, and a buoyant element to enable the structure to float. Such floating structures may be moored in a relatively fixed position by lines attached to anchoring points.

Various systems have been developed to achieve a floating breakwater. Some systems have used modular concrete shells or steel frames connected to each other by cables, with inner liners to provide buoyancy. These systems enjoy the advantage of strength and durability, but are massive and cannot easily be launched from, nor retrieved to, a dock or deck of a vessel. Furthermore, because such systems must typically be towed to their destination, they often lack the advantage of rapid deployment.

Thus, despite the use of floating breakwaters for some time, history has witnessed numerous maritime incidents in which ships have run aground in high seas while carrying valuable cargo. In many such incidents, retrieval of such cargo by other vessels has proven difficult or impossible due to an inability to rapidly attenuate wave action in the vicinity of the stricken vessel. Furthermore, certain vessels may need protected anchorage, and a need has been expressed for a robust and rapidly deployable breakwater system that can be deployed in water depths adequate for deep draft vessels, for lightering to smaller vessels or to offload vessels to other vessels or shore during high seas. Further uses for a rapidly deployable floating breakwater include protection of construction sites, swimming beaches, and beach erosion protection during reclamation efforts.

Accordingly, there exists a need for a floating breakwater system which is economical to build, which is capable of being rapidly deployed and retrieved for re-use, and which is capable of attenuating substantial wave action in open water. The present invention addresses these and other needs.

SUMMARY OF THE INVENTION

Briefly, and in general terms, the present invention is directed to a new and improved system and apparatus for a transportable and rapidly deployable floating breakwater adapted to attenuate wave action in open water. The floating breakwater includes a pressurized structure made of flexible material, which is especially configured and adapted to have enhanced stiffness and rigidity when deployed, desirable characteristics for effective wave attenuation. When properly positioned and deployed in an area of undesired wave action, the breakwater of the present invention is capable of creating a protected area of attenuated waves in the lee of the breakwater structure.

In a preferred embodiment of the invention, the breakwater includes a primary barrier in the form of an elongate tubular structure of large cross sectional size or diameter with closed ends, adapted, in the deployed state, to contain water or other liquid which is pressurized to a pressure substantially greater than that of the surrounding water. As used herein, "substantially greater" means a difference in pressure which is adequate to maintain the stiffness and achieve the buckle and wrinkle resistance required for the purpose of wave attenuation. It will be appreciated that such pressurization induces tensile forces in the material forming the wall of the primary barrier, and that such tensile forces enhance the wrinkle and buckle resistance of the material, thus enhancing the overall stiffness of the breakwater, which is a highly desirable characteristic for an effective floating breakwater. Stiffening the breakwater by this means is simple and highly efficient, as it does not require additional structural material which would otherwise be costly and add weight to the breakwater.

In a further aspect of the invention, the breakwater may be adapted so that, after its initial deployment and pressurization, the water within the primary barrier may be continually or periodically re-pressurized throughout the period of deployment of the breakwater in order to maintain a substantially constant level of pressure, or to set the pressure at a different level in order to accommodate a changed sea condition.

A flotation element may be attached to or incorporated into the primary barrier to ensure positive buoyancy of the breakwater at all times. In addition, overtopping barriers may be attached to the top of the primary barrier, adapted to be buoyant in the deployed state and to attenuate wave action which would otherwise overtop the primary barrier.

The breakwater of the present invention is adapted to be expanded from a collapsed condition to an expanded condition in the deployed state. In its deployed condition, the floating breakwater is preferably moored by at least two points along its length and prevented from drifting by mooring lines attached to the ocean bottom or other suitable fixed geographical point. In a deployed state, it is often desirable for the primary barrier to have a relatively large diameter and length. Diameters of between 2 feet and 30 feet may be suitable, depending on prevailing conditions.

In a further aspect, the primary barrier of the invention may be enclosed in or surrounded by a tubular jacket adapted to withstand the forces of the pressurized water within the primary barrier, and to further strengthen and stiffen the primary barrier. In a preferred embodiment, the jacket may be formed of circumferential and longitudinal straps interwoven with each other.

Although a single breakwater unit may be used, a breakwater system may comprise a plurality of breakwater units, incrementally added or subtracted, and arranged to relate to each other in a variety of configurations, depending on prevailing conditions.

The breakwater of the present invention can be used in situations where a permanent breakwater is not feasible, available, or timely. It is also suitable for use in transient conditions, so that it may be temporarily removed if a particularly aggressive sea condition is expected, or if seasonal conditions do not demand the protection of the breakwater. The breakwater of the present invention also has the advantages of being capable of rapid deployment from, and retrieval to, a place of storage on a reel or pallets positioned on a dock or on the deck of a vessel; of being deployed and towed to a desired location, if desired; of being rapidly expanded by filling with water; of having the ability to withstand high seas with little probability of structural failure; of being unlikely to damage vessels with which it may come into contact; and of being lightweight, inexpensive, durable, transportable, and repairable.

These and other objects and advantages of the invention will become apparent from the following more detailed description, when taken in conjunction with the accompanying drawings of illustrative embodiments.

BRIEF DESCRIPTION OF THE DRAWINGS

FIG. 5 is an enlarged cross-sectional view taken substantially along line 5—5 in FIG. 2;

FIG. 6 is an enlarged, fragmentary detail view of the connection between the primary barrier and the overtopping barriers shown in FIG. 5;

DETAILED DESCRIPTION OF THE PREFERRED EMBODIMENTS

Figure 1:
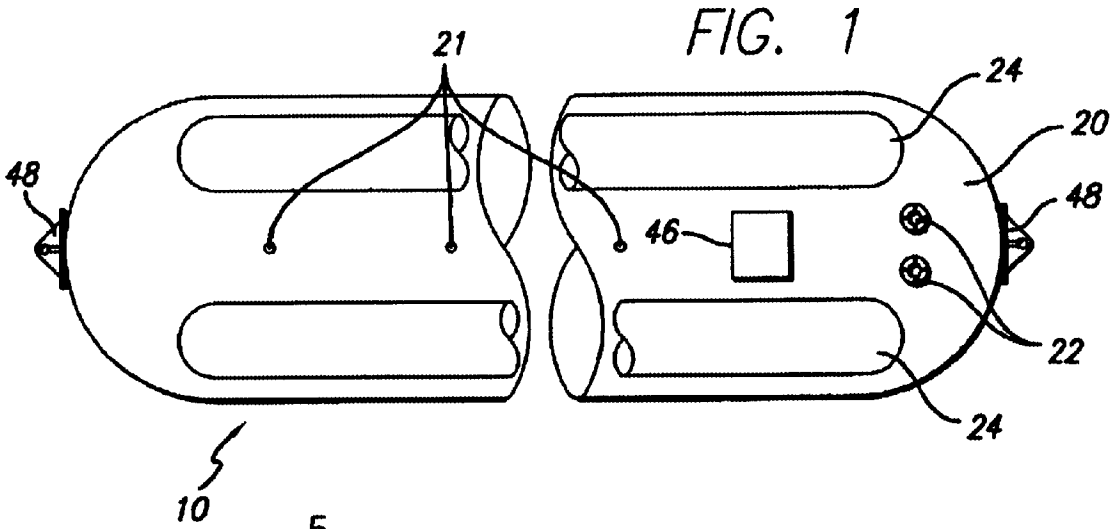
FIG. 1 is a truncated plan view of a floating breakwater system embodying novel features of the invention, showing a primary barrier with two overtopping barriers.

Referring now to the drawings, and in particular, to FIG. 1, there is shown a structure and system for one embodiment of a floating breakwater 10 incorporating novel features of the present invention. Included in the breakwater is a tubular primary barrier 20, closed at both ends, made of flexible material and adapted to be expanded from a collapsed condition to an expanded condition in the deployed state. The length of the primary barrier may preferably be in the region of five to fifty times its diameter, to simplify manufacture and deployment. Expansion of the primary barrier 20 is achieved by introducing water into its interior cavity chamber. The surface of the primary barrier may be configured to have at least one sealable opening 22, adapted to be watertight when sealed, in order to allow for the introduction of water by a pump 46 mounted on the vessel, or, mounted on the breakwater itself. During the process of pumping, the connection between the pump nozzle and the sealable openings 22 may be adapted to be watertight so as to enable and maintain pressurization of the primary barrier by pumping a desired amount of water into the cavity. Furthermore, one or more vapor relief devices 21, adapted to allow air or vapor, but not liquid, to escape from the primary barrier may be installed along the top of the primary barrier, enabling the primary barrier to be filed completely with liquid to the exclusion of air or vapor. In one embodiment, the water introduced into the cavity of the primary barrier is water from the body of water in which the breakwater is deployed. In another embodiment, fresh water may be used if the breakwater is deployed in the ocean, as such will provide enhanced buoyancy of the breakwater due to the lower density of fresh water.

A preferred material for manufacturing the primary barrier 20 is a coated textile fabric, such as a waterproof, high strength polyurethane coated polyester fabric material. Other flexible coating materials or other reinforcing fabrics, such as those made from high strength textile fiber, suitable for a marine environment also can be used. To minimize local stresses in the fabric, the barrier may be configured to have hemispherical or dome shaped ends. Prior to being deployed in the water, the primary barrier may be stored in a collapsed condition, most conveniently wound onto a hydraulically powered reel or stack-folded on either the deck of the deploying/retrieving vessel or on a dock for deployment and towing to the installation site.

In its fully deployed state, the water in the cavity of the primary barrier 20 is pressurized to a level substantially greater than the pressure of the water surrounding the barrier. The material embodying the primary barrier 20 is adapted to withstand the forces introduced by such pressure. It will be appreciated by those skilled in the art that, by pressurizing the water in the primary barrier 20, the material of the primary barrier gains wrinkle and buckle resistance, thus enhancing the primary barrier's overall stiffness. This increased stiffness has beneficial effects on the ability of the water-filled primary barrier 20 to attenuate wave action, as it enables the breakwater to float in the water as an effectively rigid beam.

The desired level of pressurization in the primary barrier is preferably the pressure necessary to resist wrinkle formation in the side of the barrier that is exposed to both current load and wave load. (This will be the worst case, since if the current is applied in the opposite direction to that of the waves, their two load effects will tend to cancel each other.) For any pressurized thin-walled vessel having a diameter D, that is placed in a flowing fluid current with density ρ and velocity V, and is moored at points L distance apart, the pressure P that will resist wrinkling in the thin wall is given by the relationship:

$$P \approx (\rho/\pi g)\,(VL/D)^2$$

where g=acceleration due to gravity.

If the wave loading is expressed as a current with a velocity such as would induce an amount of bending in the primary barrier equivalent to that induced by the waves, then the velocity of the actual current ($V_{current}$) may be added to the velocity of the (putative) wave induced current ($V_{wave_induced}$) to give an effective current velocity ($V_{effective}$), as follows:

$$V_{effective} = V_{current} + V_{wave_induced}$$

Thus, in the case of a pressurized primary barrier exposed to both current and wave action forces:

$$P \approx (\rho/\pi g)\,(V_{effective} L/D)^2$$

From this relationship it will be seen that, for a given fluid condition and given spacing of mooring points, the pressure required to resist wrinkle formation on the side of the beam exposed to current and wave action is inversely proportional to the square of the diameter of the barrier.

Pressurization of the water may be achieved by pumping into the cavity of the primary barrier, via inlet ports 22, the volume of water required to achieve the desired pressure and level of stiffness. When fresh water is to be used, such will generally be pumped into the cavity while the breakwater is near the shore, whereafter the breakwater will be towed out to its desired location. It will be appreciated that once the desired pressure is initially established, the same may dissipate due to leakage of the water from the primary barrier, or from material stretching, or from changes in temperature. Moreover, it may be found that an initially established pressure must be increased to resist buckling and wrinkling and to maintain the desired stiffness for changing sea conditions. In such cases, pumping may be resumed continuously, intermittently, or at periodic intervals to maintain or vary the desired water pressure after the breakwater is initially fully deployed and pressurized.

Moreover, it is not necessary that the desired water pressure within the primary barrier 20 be maintained only by pumping additional water into the cavity of the primary barrier. The water pressure may be maintained by sealing the primary barrier in a waterproof manner or also by pumping air or other gas into one or more inflatable pressurization tubes 23 (FIG. 5) with closed ends which may be positioned within the cavity of the primary barrier 20. A pressurization tube 23 may be fabricated from the same flexible material as the primary barrier 20. Where a pressurization tube is included, it will serve the additional function of maintaining buoyancy of the breakwater 10. Furthermore, water pressure within the primary barrier may be maintained by adding a water reservoir, in the form of a standpipe, to the top surface of the barrier, containing water to a level adequate to provide the desired differential pressure within the primary barrier.

In a preferred embodiment, it is presently believed that the breakwater 10 will attenuate incoming waves in two ways. Short period, smaller waves may be attenuated primarily by the inertial mass of the water in the larger diameter pressurized primary barrier 20, and by overtopping barriers 24 which deflect wave crests from breaking across the primary barrier. Longer period waves may be attenuated both by the inertial mass of the water in the primary barrier, and by the stiffness of the primary barrier. The stiffness of the primary barrier resists lateral deformation (both horizontal and vertical) of the breakwater, and thereby reduces the transmission of larger waves across the breakwater to the lee side.

Figure 2:
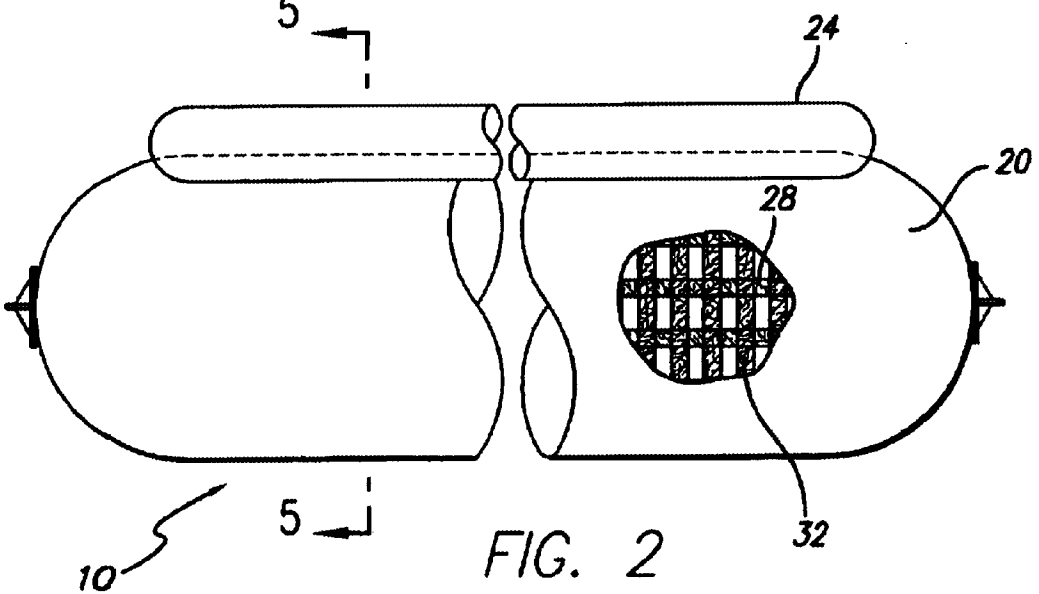
FIG. 2 is a side elevational view of the breakwater system shown in FIG. 1, additionally showing in enlarged cutaway section the circumferential and longitudinal straps which may encase the primary barrier.
Figure 3:
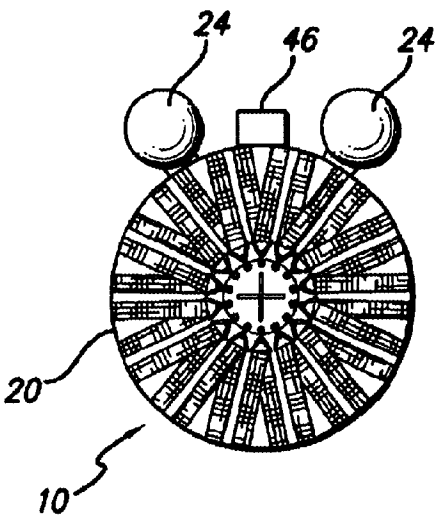
FIG. 3 is an end view of the view of the breakwater system shown in FIG. 2, showing longitudinal straps connected to a collector plate.
Figure 4:
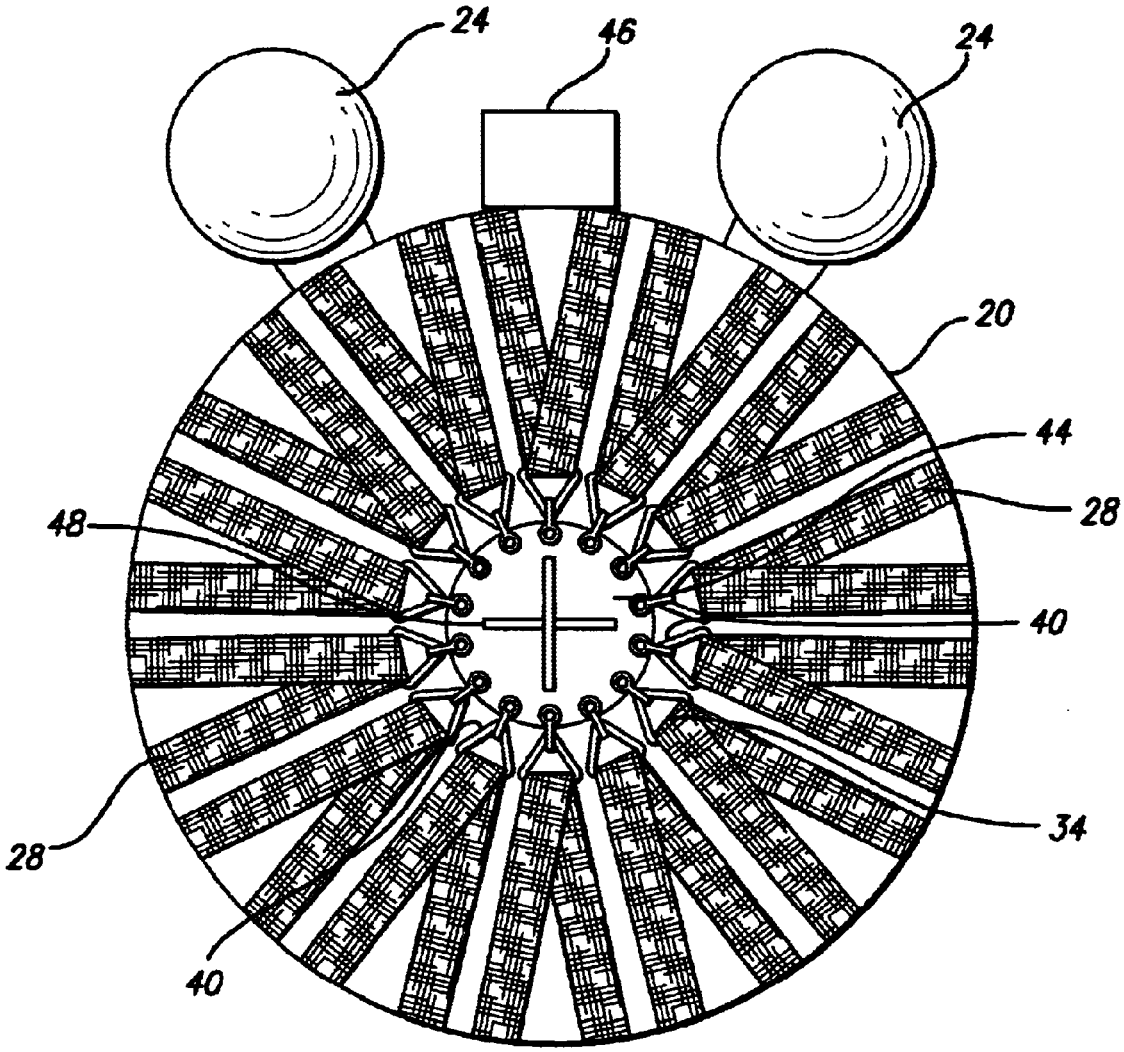
FIG. 4 is an enlarged view of FIG. 3.

In a further aspect of the invention, the strength and stiffness of the primary barrier 20 may be enhanced by enclosing the same in a flexible cylindrical jacket, so that the forces in the fabric of the primary barrier are transferred to the jacket. In this aspect of the invention, the primary barrier 20 may be adapted principally to contain the pressurized water within its cavity, while the jacket may be adapted principally to sustain the forces generated by the pressurized water and wave action, and simultaneously to provide increased stiffness of the breakwater 10. This enables the primary barrier to be made from a lighter weight fabric with less tensile strength, if desired. In a preferred embodiment, exemplified in FIGS. 2 and 4, the jacket may comprise a plurality of straps, which may be longitudinal straps 28 and circumferential straps 32 configured to enclose or surround the primary barrier 20. The circumferential straps 32 may be interwoven with the longitudinal straps 28, thus providing the circumferential straps with a restraint against longitudinal movement. The tightness or closeness of the weave may be varied. As exemplified in FIG. 4, two adjacent longitudinal straps 28 may be configured to form a continuous loop, thus permitting their ends 34 to be conveniently gathered at the axis of the primary barrier 20 and attached by links 40 to a collector plate 44. In an alternative embodiment, the jacket may consist of oppositely wound straps (not shown in such configuration) which are oriented at an oblique angle to the axis of the primary barrier 20, rather than being oriented parallel and at right angles to the axis. A preferred configuration for the obliquely wound straps is to position oppositely wound straps in helical configuration at an angle of approximately 50 to 60 degrees, preferably 57 degrees, to the axis of the primary barrier. The presently preferred material from which to manufacture the straps is polyester, but other material made from high strength textile fibers also can be used. Both collector plate 44 and links 40 may be constructed from suitably non-corrosive material such as galvanized or stainless steel. It will be appreciated that, while the jacket may be made removable or permanently applied to the barrier, the jacket should be connected to the primary barrier, especially during pressurization, so as to prevent dislocation of the jacket from its desired position on the barrier. Simple stitching at intervals may be adequate to prevent such dislocation.

It is estimated that a primary barrier 20 having a diameter of between about 6 feet and 30 feet will optimally attenuate wave action in an offshore environment, depending on prevailing conditions, while a primary barrier having a diameter of between about 2 feet and 12 feet in diameter will optimally attenuate wave action in nearshore conditions.

Various factors and conditions may affect the overall optimal configuration of the breakwater. As is apparent from the relationship set forth above, the effective current velocity and the distance between mooring points on the breakwater play primary roles in determining the optimal configuration. Other factors include the amount of wave energy reduction required, the water depth, the extent to which the breakwater protrudes above water level, the breakwater's mass and cross sectional shape, the type of mooring restraint, the wave height, the wave period, the wind velocity, the water temperature, and other environmental factors. Thus, the relationship set forth in the above formula should be seen only as a convenient guide to estimating an initial pressure for the primary barrier. For any given breakwater, the most suitable pressure for any given sea condition may be determined by varying the pressure of the deployed primary barrier from its initial estimated pressure until it behaves satisfactorily. As noted above, it may be found that the initially established pressure dissipates over time, or that an increased pressure is required to deal with an increased sea condition. Such pressure maintenance or variation may be accomplished by periodic or continued pumping and relief during the period the breakwater is deployed.

Although the most appropriate pressure for a primary barrier of given diameter is dependent on many variables, a preferable range of differential pressures (measured as the difference between pressure internal to the barrier and pressure external thereto at any level) may be as follows. For barriers having a diameter of at least two feet, a differential pressure of at least about 10 psi may be preferred; for barriers having a diameter of at least 4 feet, at least about 3 psi may be preferred; for barriers having a diameter of at least 6 feet, at least about 1 psi is preferred; and, for barriers having a diameter of at least 12 feet, at least about 0.5 psi is preferred.

It is presently contemplated that barriers configured in accordance with the present invention may be used at differential pressures ranging from about 0.5 psi (for the largest diameters) to at least 30 psi, depending on size and prevailing conditions, with pressures of about 2–10 psi being common for larger diameter systems.

In a further aspect of the present invention exemplified in FIGS. 1–5, one or more tubular overtopping barriers 24 made of flexible material and adapted to be expanded from a collapsed condition to an expanded condition in the deployed state may be attached to the primary barrier 20 at or near the waterline. In one embodiment, the overtopping barriers are filled with air in the deployed state and, preferably, have a smaller diameter than the primary barrier. In another embodiment, the overtopping barriers may be filled with closed cell foam, or similar buoyant material. As they are buoyant, the overtopping barriers 24 will extend substantially above the surface of the water in the deployed state, where they will serve to attenuate the progress of smaller waves or the tips of larger waves which would otherwise crest over the primary barrier and disturb the surface of the water in the lee of the breakwater 10. The overtopping barriers 24 can be constructed to perform the additional secondary functions of adding to the stability and overall buoyancy of the breakwater 10. Although a number of overtopping barriers may be used, it has been found that two are preferable. A location on top of the primary barrier 20 within an arc of about 30 degrees on each side of the vertical centerline projected upward from the center of the primary barrier is considered suitable for this purpose.

The overtopping barriers 24 may be attached in their collapsed state to the primary barrier 20 in its collapsed state in the manner exemplified in FIG. 6, which shows how flexible flaps 50 may be connected to both overtopping barrier 24 and primary barrier 20 so as to overlap with each other. A plurality of grommets 54 may be inserted into the flaps to facilitate attachment using flexible polyester cord. The preferred material for manufacturing the overtopping barriers and the attachment flaps is the same high strength polyurethane coated polyester fabric material from which the primary barrier may be manufactured. This configuration permits the entire breakwater 10 to remain flexible in its collapsed state, allowing it to be wound onto a reel or to be folded onto a dock or the deck of a vessel. The overtopping barrier 24 can be attached to the primary barrier 20 or to the jacket enclosing the primary barrier in a variety of other ways if desired.

In a further aspect of the invention, exemplified in FIG. 5, a flexible flotation element 36 may be attached to the upper surface of the primary barrier 20, preferably the inside surface although the outside surface may be desirable if water pressure in the primary barrier is likely to compress the flotation element and reduce its buoyancy excessively. The flotation element 36 may be made of a layer of light-weight closed-cell foam, and is configured to ensure positive buoyancy and promote vertical orientation of the vertical centerline of the breakwater 10. Typically, the breakwater will, overall, be configured with sufficient buoyancy such that the primary barrier 20 will just float at the tope of the nominal water surface. It will be appreciated that the flotation element 36 should be sufficiently flexible to permit it to be wound onto a storage reel, or to be folded, along with the other flexible elements of the breakwater 10.

It will further be appreciated that, in the deployed state, the space between two adjacent overtopping barriers 24 may provide a convenient protected walkway when the breakwater 10 is made from sufficiently large barriers, thereby providing a somewhat protected platform for operation, inspection, and maintenance of the breakwater. Where continued pumping is required to maintain or vary the water pressure within the cavity of the primary barrier 20, as referenced above, it may nevertheless become necessary for the support vessel to leave the vicinity of the breakwater. In this event, it may be desirable to mount a pump 46 on the upper surface of the primary barrier 20 (especially where protective overtopping barriers 24 are attached to the jacket or primary barrier) to maintain or vary the pressure within the primary barrier by means of continued pumping. Pumping may be triggered, if necessary, by a switch configured to sense the pressure within the primary barrier and to switch on the pump when the pressure falls below a designated level. Furthermore, where straps 28, 32 are used to strengthen and stiffen the primary barrier, the same may form a conveniently rigid slip-resistant surface between the overtopping barriers 24 to facilitate movement of personnel along the length of the breakwater 10.

Figure 7:
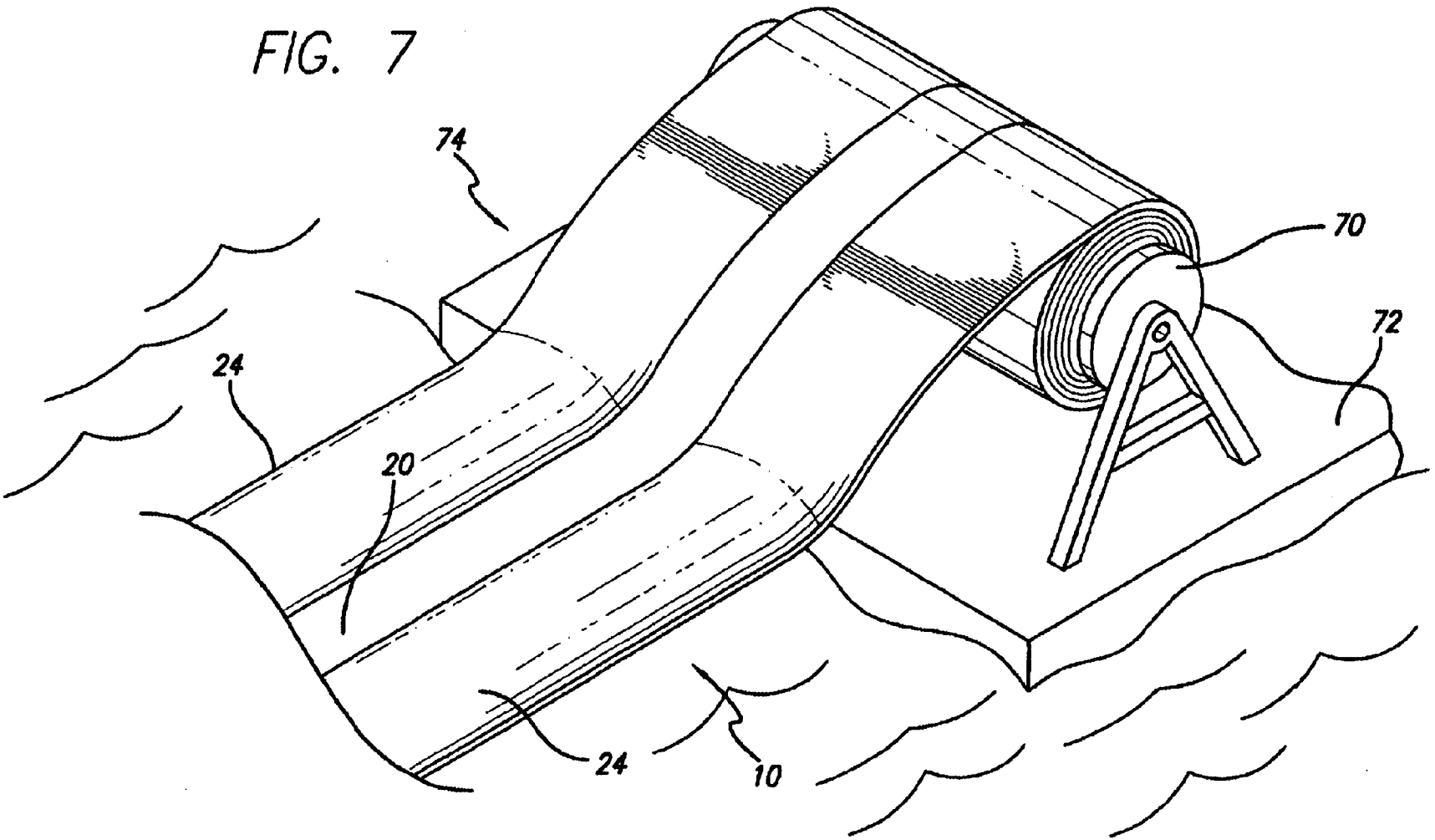
FIG. 7 is a fragmentary schematic view of a vessel launching from its deck a breakwater system embodying features of the present invention.

As to storage, deployment, and retrieval, FIG. 7 exemplifies how the breakwater 10 may be stored on a hydraulically powered reel 70 on the deck 72 of a vessel 74. A suitable method for deploying the breakwater from the deck of the vessel may be to anchor one end at a desired location in a body of water and then to power the vessel away from the mooring point while unwinding from the reel and playing out the breakwater behind the vessel. On retrieval, the primary barrier may be drained of its liquid contents under the effect of gravity as it is recovered upwards from the water onto a reel on a dock or recovery vessel.

It will be appreciated that positioning a breakwater 10 at right angles to the direction of the approaching waves achieves the longest shadow of calm water behind the breakwater. Depending on the prevailing conditions, it has been found that the breakwater of the present invention will adequately attenuate wave action when thus positioned. Alternatively, a breakwater 10 may be positioned at an angle to the direction of the approaching waves. While this orientation provides a narrower shadow of calm water behind the breakwater, it may have the advantage of enabling the breakwater to attenuate more energetic wave action. Whatever length is used for each breakwater unit, it may be desirable to attach a number of breakwaters 10 to each other end-to-end, to form an elongated breakwater system which may exceed 1000 feet in length. In a variation of this aspect, the breakwaters may be positioned to form an arc around a specific point of interest. Alternatively, a series of parallel breakwater units may be positioned in staggered, shingle-like fashion, in the path of the oncoming waves. In a further variation, a breakwater system may include a plurality of barriers arranged as a "V," pointing into the oncoming waves, or as a "λ" (lambda) with the long leg presenting a straight barrier positioned at an angle to the path of the oncoming waves. The ideal orientation, in each case, is determined by wind, current and wave conditions.

Figure 8:
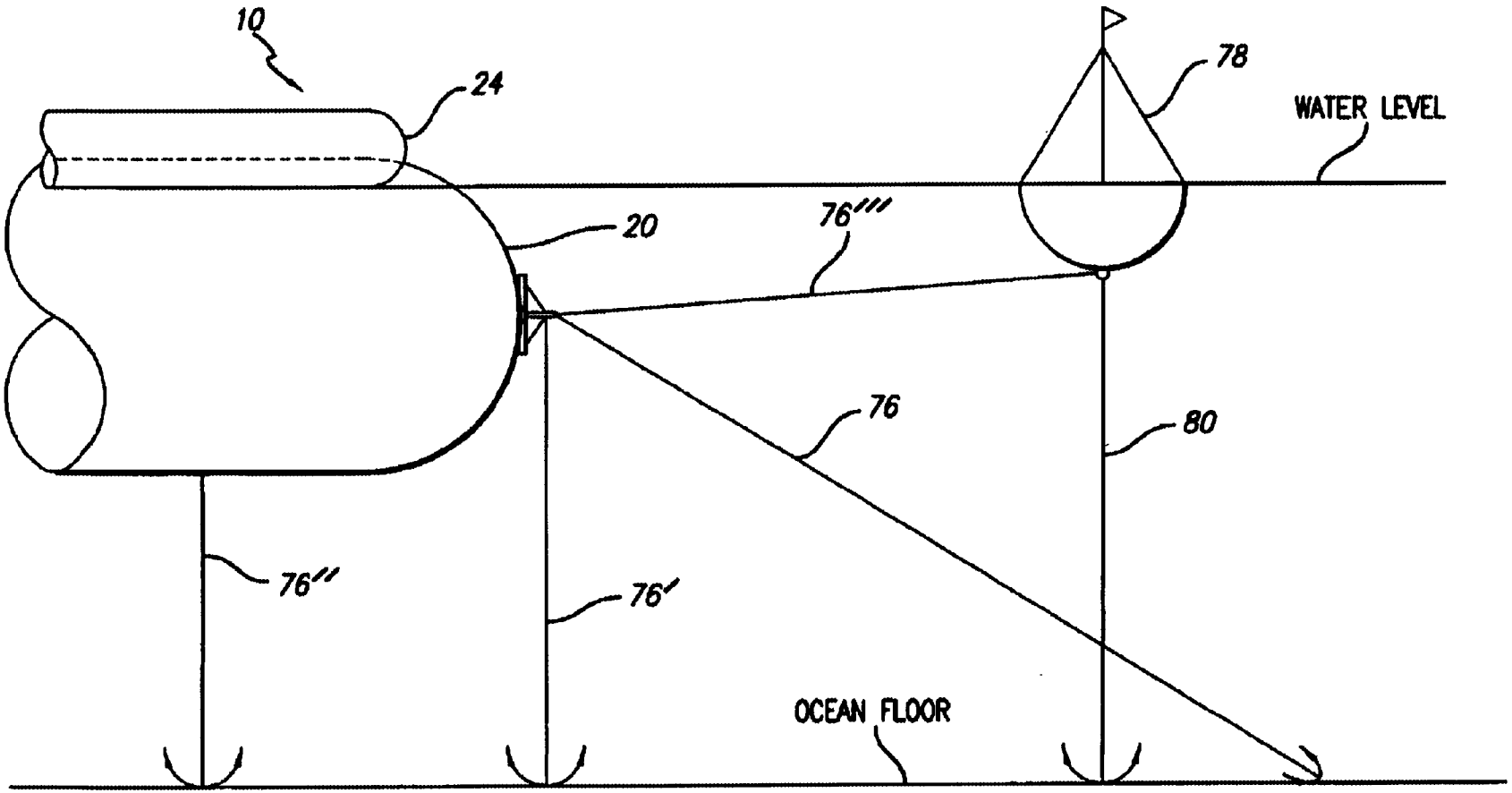
FIG. 8 is a fragmentary elevational view of the breakwater system shown in FIG. 2 deployed in water and moored to the ocean floor.

As noted above, it is estimated that a primary barrier 20 having a diameter between about 6 feet and 30 feet will optimally attenuate wave action in an offshore condition, while a primary barrier having a diameter between about 2 feet and 12 feet will optimally attenuate wave action in a nearshore condition. Suitable corresponding tubular overtopping barriers for such configurations will have a size of about 3 feet to 6 feet and about 1 foot to 4 feet in diameter, respectively. When finally positioned as desired, each breakwater structure 10 may be moored to the bottom, as exemplified in FIG. 8, by means of mooring lines 76, 76', 76", 76'" attached to mooring attachments 48 on the breakwater, and any suitable anchoring means, either on a buoy 78 or on the ocean floor. The buoy may itself be anchored with a mooring line 80 to the ocean floor. Mooring attachments 48, exemplified in FIGS. 1, 2 and 4, may be constructed from suitable non-corrosive material such as galvanized or stainless steel. In addition to mooring the breakwater by its ends, additional intermittent mooring lines 76" may be attached to the breakwater intermediately between the ends, attachment being effected by using an appropriate load spreading attachment system (not shown). The mooring lines serve to maintain the desired location and orientation of the breakwater relative to the approaching waves.

Figure 9:
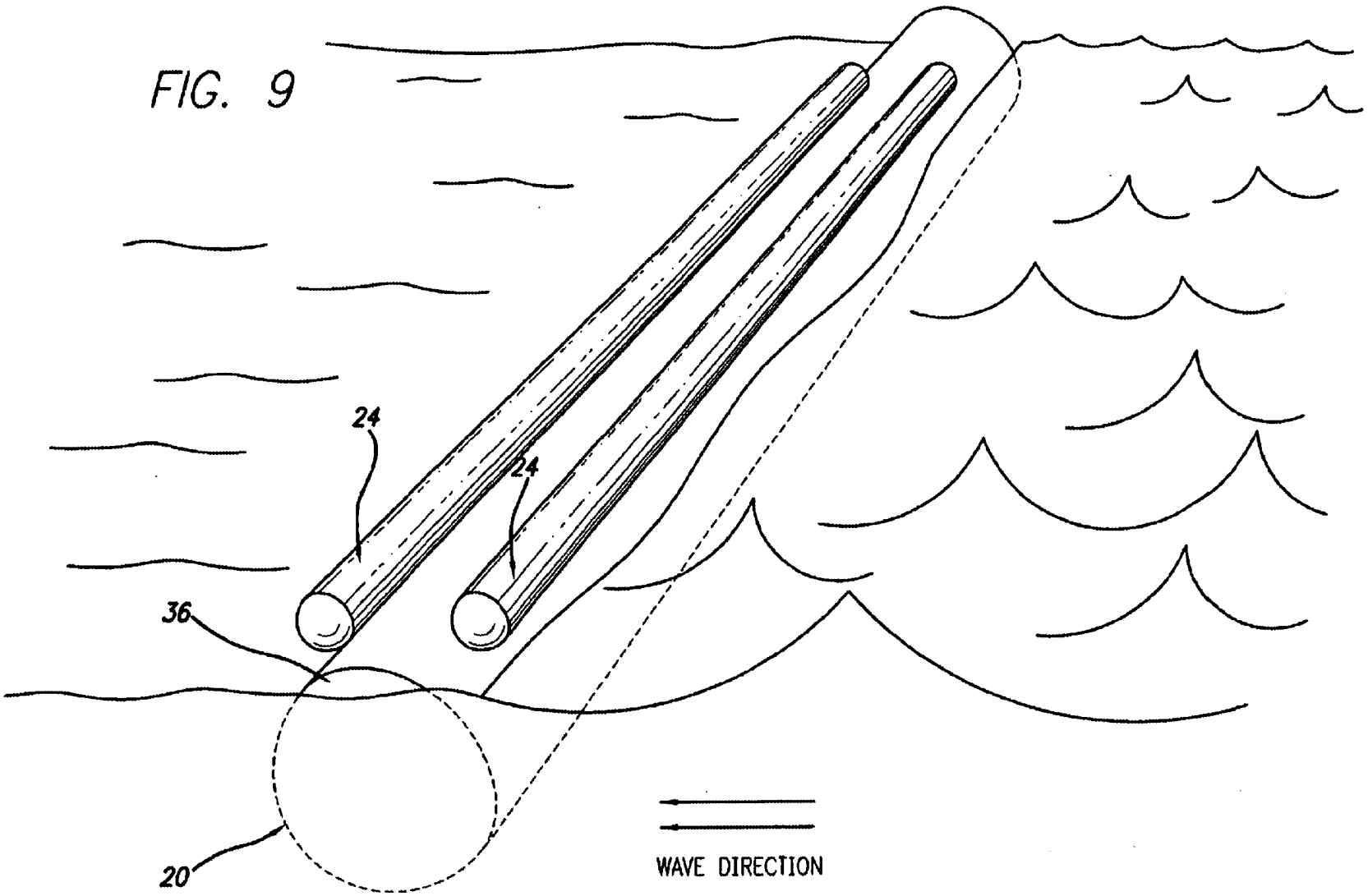
FIG. 9 is a schematic perspective view, in section, of the breakwater system of FIG. 2, deployed in water.

FIG. 9 exemplifies the operation of the breakwater system of the present invention. Waves reaching the breakwater are attenuated by the inertial mass of the primary barrier, and any cresting over the top of the primary barrier is reflected or attenuated by the overtopping barriers, providing an area of relative calm in the lee of the breakwater.

The breakwater of the present invention has the primary advantage of maintaining an enhanced stiffness through pressurization of its fluid contents, so that the breakwater may act as a rigid beam in the water, capable of absorbing and attenuating wave action. Other advantages include being economical in that it is easy to build, to transport, to rapidly deploy and retrieve, to repair, and to store. It may be made primarily from inexpensive, durable fabric, which, being lightweight and flexible, is unlikely to cause substantive damage to vessels even in elevated sea condition conditions. Indeed, the breakwater may serve the additional function of buffering ships from colliding with maritime objects, and a vessel would be able to moor alongside the breakwater without the need for additional fendering. The breakwater may be pressurized to maintain a desired level of stiffness to reduce wave action. The internal pressure of the primary barrier 20 may be controlled as necessary to provide the optimum wave suppression for a given condition. The materials embodying the breakwater may all be corrosion resistant materials that have demonstrated long-life capabilities both in the stored and deployed environments. By fabricating the breakwater as a continuous structure, frequent joints can be avoided.

It will be apparent from the foregoing that, while particular forms of the invention have been illustrated and described, various modifications can be made without departing from the spirit and scope of the invention. For example, while the drawings of the Figures illustrate primary barrier 20, overtopping barrier 24, and pressurization tube 23 each having a circular cross section, the exact cross sectional shape of these elements can be varied, and may in each case assume any cross sectional shape capable of performing the element's described function. Accordingly, it is not intended that the invention be limited, except as by the appended claims.

We claim:

1. A floating breakwater structure to be moored in an open body of water at a selected location to attenuate wave action for a desired period of time, comprising:

a primary barrier made of flexible material and having an internal inflatable cavity adapted to be pressurized by the introduction of water;

flexible flotation material attached to an upper portion of the primary barrier;

at least one vapor relief device attached to the primary barrier;

a mooring attachment associated with the primary barrier;

water filling the primary barrier such that the primary barrier is pressurized to a level that resists wrinkling and buckling of the primary barrier under influence of the wave action to be attenuated.

2. The breakwater structure of claim 1 wherein the flexible flotation material is attached to the outer surface of the primary baffler.

3. The breakwater structure of claim 1 wherein the flexible flotation material is attached to the inner surface of the primary baffler.

4. The breakwater structure of claim 1 further comprising a jacket configured to closely surround the primary barrier so as to withstand pressurization forces within the primary barrier.

5. The breakwater structure of claim 4 wherein the jacket comprises a plurality of longitudinal straps and a plurality of circumferential straps.

6. The breakwater of claim 5 wherein the plurality of longitudinal straps include two adjacent longitudinal straps forming a continuous loop.

7. The breakwater of claim 6 wherein the primary barrier has an axis, and the continuous loop has ends that are gathered at the axis of the primary barrier, and each end respectively is attached to a collector plate.

8. The breakwater structure of claim 7 wherein the tubular jacket comprises a plurality of helically wound straps.

9. The breakwater structure of claim 5 or claim 8 wherein the straps are made from high strength textile fiber.

10. The breakwater structure of claim 1 further comprising at least one tubular overtopping barrier attached to an upper portion of the primary barrier, the overtopping barrier being configured to attenuate waves which would otherwise crest over the primary barrier.

11. The breakwater structure of claim 10 comprising two overtopping barriers, the two overtopping barriers being parallel to each other and spaced apart so as to provide a walkway therebetween.

12. The breakwater structure of claim 10 wherein the at least one overtopping barrier is formed of a flexible tubular element, adapted to be expanded from a collapsed condition to an expanded condition.

13. The breakwater structure of claim 10 wherein the at least one overtopping barrier is filled with buoyant material.

14. The breakwater structure of claim 13 wherein the buoyant material is air.

15. The breakwater structure of claim 13 wherein the buoyant material is closed cell foam.

16. The breakwater structure of claim 1 wherein the flotation material comprises closed cell foam.

17. The breakwater of claim 1 wherein the primary barrier is made of coated textile fabric.

18. The breakwater of claim 1, further comprising a pump positioned on the primary barrier adapted to maintain a desired pressure within the primary barrier.

19. A method of attenuating wave action in a body of open water comprising the steps of:

placing in the open water a floating breakwater assembly having a primary barrier made of flexible material and having an internal inflatable cavity adapted to be pressurized by the introduction of water and flexible flotation material at a top portion of the primary barrier;

pressurizing the primary barrier by introducing water into the internal cavity and elevating the pressure in the primary barrier to a level that resists wrinkling and buckling of the primary barrier under influence of the wave action to be attenuated;

permitting any gas within the primary barrier to escape via a vapor relief valve;

maintaining the pressure within the primary barrier at a substantially constant level by introducing more water as needed; and mooring the primary barrier at a selected location and orientation in a body of open water to attenuate wave action in a predetermined area.

20. The method of claim 19 including the further step of providing at least one overtopping barrier on the primary barrier.

21. The method of claim 19 including the further step of mooring the breakwater by at least two points along the length of the primary baffler.

22. The method of claim 19, including the further step of varying the level of pressurization within the primary barrier to accommodate a variation in sea state.

23. The method of claim 19 including the further step of retrieving the primary barrier when the wave action no longer requires attenuation.

24. The method of claim 19 wherein the flexible flotation material is attached to the outer surface of the primary barrier.

25. The method of claim 19 wherein the flotation material comprises closed cell foam.

26. The method of claim 19 wherein the wave action has a prevailing direction and the primary barrier is oriented substantially at right angles to the prevailing wave direction.

27. The method of claim 19 wherein the wave action has a prevailing direction and the primary barrier is oriented at an oblique angle to the prevailing wave direction.

28. A floating breakwater structure to be moored in an open body of water at a selected location to attenuate wave action for a desired period of time, comprising:

a primary barrier made of flexible material and having an internal inflatable cavity adapted to be pressurized by the introduction of water;

flexible flotation material attached to an upper portion of the primary barrier;

at least one vapor relief device attached to the primary barrier;

a mooring attachment associated with the primary barrier;

the primary barrier having a first collapsed condition that is flexible, allowing the barrier to be compacted and stored, and a second expanded condition upon being filled and pressurized with water that is rigid, resisting wrinkling and buckling of the primary barrier under influence of the wave action to be attenuated.

29. The breakwater structure of claim 28 wherein the flexible flotation material is attached to the outer surface of the primary barrier.

30. The breakwater structure of claim 29 further comprising at least one tubular overtopping barrier attached to an upper portion of the primary barrier, the overtopping barrier being configured to attenuate waves which would otherwise crest over the primary barrier.

31. The breakwater structure of claim 30 comprising two overtopping barriers, the two overtopping barriers being parallel to each other and spaced apart so as to provide a walkway therebetween.

32. The breakwater structure of claim 30 wherein the at least one overtopping barrier is formed of a flexible tubular element, adapted to be expanded from a collapsed condition to an expanded condition.

33. The breakwater structure of claim 30 wherein the at least one overtopping barrier is filled with buoyant material.

34. The breakwater structure of claim 33 wherein the buoyant material is air.

35. The breakwater structure of claim 33 wherein the buoyant material is closed cell foam.

36. The breakwater structure of claim 28 wherein the flexible flotation material is attached to the inner surface of the primary barrier.

37. The breakwater structure of claim 28 further comprising a jacket configured to closely surround the primary barrier so as to withstand pressurization forces within the primary barrier.

38. The breakwater structure of claim 37 wherein the jacket comprises a plurality of longitudinal straps and a plurality of circumferential straps.

39. The breakwater of claim 38 wherein the plurality of longitudinal straps include two adjacent longitudinal straps forming a continuous loop.

40. The breakwater of claim 39 wherein the primary barrier has an axis, and the continuous loop has ends that are gathered at the axis of the primary barrier, and each end respectively is attached to a collector plate.

41. The breakwater structure of claim 37 wherein the tubular jacket comprises a plurality of helically wound straps.

42. The breakwater structure of claim 37 or claim 41 wherein the straps are made from high strength textile fiber.

43. The breakwater structure of claim 28 wherein the flotation material comprises closed cell foam.

44. The breakwater of claim 28 wherein the primary barrier is made of coated textile fabric.

45. The breakwater of claim 28, further comprising a pump positioned on the primary barrier adapted to maintain a desired pressure within the primary barrier.

46. A breakwater structure to be moored in open water at a selected location to attenuate wave action for a desired period of time, comprising an elongated primary baffler formed of a flexible material and having an enclosed interior cavity, said baffler being adapted to float in open water and to contain a liquid within said cavity pressurized to a level substantially greater than the pressure of the surrounding open water, wherein the pressurized liquid provides the barrier with enhanced stiffness and resistance to deformation by wave action, and further comprising a tubular jacket adapted to surround said primary barrier, said tubular jacket comprising a plurality of longitudinal straps and a plurality of circumferential straps.

47. The breakwater structure of claim 46 wherein said longitudinal and circumferential straps are made from high strength textile fiber.

48. A breakwater structure to be moored in open water at a selected location to attenuate wave action for a desired period of time, comprising an elongated primary barrier formed of a flexible material and having an enclosed interior cavity, said barrier being adapted to float in open water and to contain a liquid within said cavity pressurized to a level substantially greater than the pressure of the surrounding open water, wherein the pressurized liquid provides the barrier with enhanced stiffness and resistance to deformation by wave action, and further comprising a tubular jacket adapted to surround said primary barrier, said tubular jacket comprising a plurality of helically wound straps.

49. The breakwater structure of claim 48 wherein said helically wound straps are made from high strength textile fiber.

50. A breakwater structure to be moored in open water at a selected location to attenuate wave action for a desired period of time, comprising an elongated primary barrier formed of a flexible material and having an enclosed interior cavity, said barrier being adapted to float in open water and to contain a liquid within said cavity pressurized to a level substantially greater than the pressure of the surrounding open water, wherein the pressurized liquid provides the barrier with enhanced stiffness and resistance to deformation by wave action, and at least one inflatable pressurization tube located within the primary barrier.

51. A method of attenuating wave action in a body of open water comprising the steps of:

placing in the open water a primary barrier made of flexible material and adapted to contain a liquid;

introducing liquid into the primary barrier;

pressurizing the liquid within the primary barrier to a level substantially greater that that of the surrounding open water;

maintaining the pressure within the primary barrier;

mooring the primary barrier at a selected location and orientation in a body of open water to attenuate wave action in a predetermined area; and retrieving the primary barrier when the wave action no longer requires attenuation, by draining the liquid from the primary barrier; and reeling the primary barrier onto a reel.

* * * * *

UNITED STATES PATENT AND TRADEMARK OFFICE

CERTIFICATE OF CORRECTION

PATENT NO. : 6,767,162 B2
DATED : July 27, 2004
INVENTOR(S) : Frank Meyers and John A. Brown It is certified that error appears in the above-identified patent and that said Letters Patent is hereby corrected as shown below:

Column 7,
Line 57, change “float at the tope of” to -- float at the top of --

Column 9,
Line 26, change “elevated sea condition conditions.” to -- elevated sea conditions. --

Column 10,
Lines 3 and 6, change “the primary baffler.” to -- the primary barrier. --

Column 11,
Line 8, change “the primary baffler.” to -- the primary barrier. --

Column 12,
Line 28, change “an elongated primary baffler” to -- an elongated primary barrier. --
Line 30, change “said baffler being adapted” to -- said barrier being adapted --

Signed and Sealed this

Twenty-sixth Day of July, 2005

JON W. DUDAS
*Director of the United States Patent and Trademark Office*